United States Patent [19]

Horung et al.

[11] 3,947,016

[45] Mar. 30, 1976

[54] CONTROL ARRANGEMENT FOR SHEET FEEDER

[75] Inventors: Adolf Horung, Rohrbach; Werner Kistner, Neckarweihingen, both of Germany

[73] Assignee: Maschinenbau Oppenweiler GmbH, Oppenweiler, Germany

[22] Filed: May 14, 1974

[21] Appl. No.: 469,896

[30] Foreign Application Priority Data

May 14, 1973 Germany ..... 2324261

[52] U.S. Cl. ..... 271/12; 271/96; 271/111; 271/265

[51] Int. Cl.[2] ..... B65H 3/10; B65H 5/02

[58] Field of Search ..... 271/96, 108, 111, 110, 271/259, 258, 10–13, 34, 35, 260, 261, 265

[56] References Cited

UNITED STATES PATENTS

| | | | |
|---|---|---|---|
| 2,171,362 | 8/1939 | Gulliksen | 271/259 X |
| 2,856,187 | 10/1958 | Burckhardt et al. | 271/96 |
| 3,108,801 | 10/1963 | Van Dalen | 271/34 X |

*Primary Examiner*—Evon C. Blunk
*Assistant Examiner*—Bruce H. Stoner, Jr.
*Attorney, Agent, or Firm*—Hopgood, Calimafde, Kalil, Blaustein & Lieberman

[57] ABSTRACT

The invention relates to a control arrangement for sheet feeders having a pull-off device for transferring the sheets serially to a continuously operating conveyor apparatus, with disposed in the path of the sheets, a sensor which, when it recognises the rear edge of a sheet, generates a switching signal by means of which the pull-off device can be switched on, and having a switch arrangement by means of which the pull-off device can be switched off after a delay.

17 Claims, 14 Drawing Figures

12
13
41 42 43 44 45 46 47 48 49 50 51 52 53 54 55 56
16
10
11
6
14
24 V~
4 3
1 2 3
30
3
1

15
36
P1
P2
$r_1$
47
48
M
56
14
55
49
50
1,8 V~
17
51
52
20
46
24V~
24V=
54
53
18
19
R
21
26
41
Ā
22
$E_1$
$E_2$
$E_3$
$E_4$
$E_5$
23
Ā
25
A
42
Ā
27
24
29
P2
ER
45
28
33
P1
31
32
M
43
44

Fig. 4a
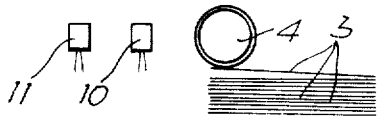
Fig. 4b
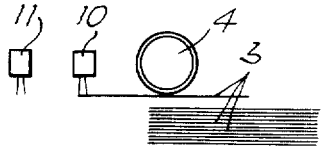
Fig. 4c
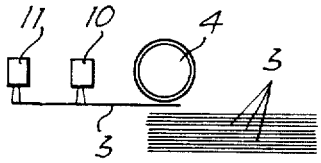
Fig. 4d
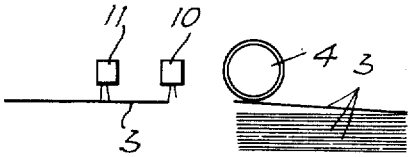
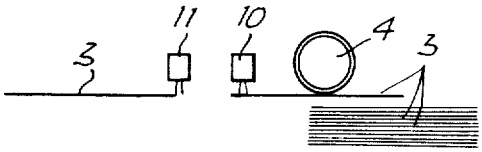
Fig. 4e
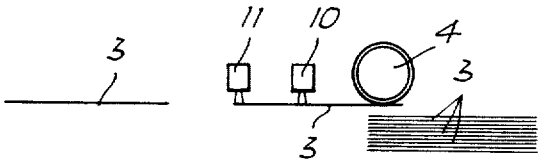
Fig. 4f
Fig. 5a
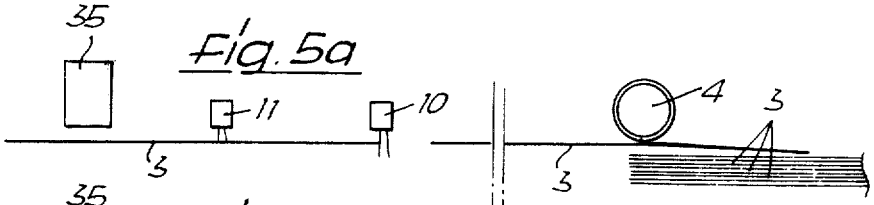
Fig. 5b
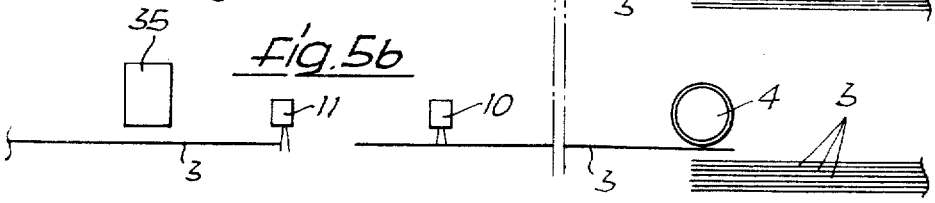

CONTROL ARRANGEMENT FOR SHEET FEEDER

Known control arrangements of this type switch the pull-off device, which is preferably constructed as a constantly rotating suction wheel which can be switched to and from the effective and ineffective conditions by means of a valve, alternately on and off. The moment of switching is determined thereby by the position of a control shaft, the rotary speed and angular position of which are in a predetermined relationship to the speed of conveyance of the conveying apparatus and of the pull-off arrangement or with the operating cycle of the pull-off device. In order to be able to effect the necessary adaptation of the switching times for the pull-off device to different sizes of sheets and different speeds of operation, preferably infinitely variable, regulating transmissions with switching cams are used. In addition to the relatively considerable cost, a further disadvantage in this case is the necessity to adjust the control system accurately to the new sizes whenever there is a change in the format length and in the working speed, because the time taken is relatively considerable even in the case of an experienced operator. Moreover, during the test runs required for correct adjustment, there may be breakdowns in sheet feeding which means that sheets becomes useless. These disadvantages also occur if pulse transmitters are used since also these have to be adjusted afresh whenever there is a change in speed and/or format length.

It has indeed already been suggested to provide the control arrangement with a sheet feeler under which the sheets conveyed by the pull-off device travel a short distance and which, upon recognising the leading edge of a sheet, switches the pull-off device to the ineffective state after a delay and allows it to resume the effective condition only when the sheet feeler has recognised the rear edge of the sheet. In consequence, the next sheet is not conveyed by the pull-off device until the rear edge of the preceding sheet is at a definite distance from the leading edge of the following sheet. Since this distance depends upon the location of the sheet sensor or feeler along the path, then in theory it is independent of the sheet length and working speed. To this extent, therefore, a readjustment of the control arrangement when there is a change in sheet length or working speed is unnecessary. Furthermore, relatively small distances between two successive sheets can be adjusted which is important to the efficiency of the sheet feeder.

Nevertheless, in the case of this proposal which does not form part of the state of the art, trouble-free operation is not possible without the control arrangement being adapted to different sheet formats and working speeds, because a change of format or of working speed necessitates an adaptation of a delay after which the pull-off device is switched off, once the leading edge of the sheet has reached the sheet feeler. A long and heavy sheet namely requires a longer switched-on period for the pull-off device in order to be reliably taken up by the continuously operating conveyor apparatus and transported on, than light and short sheet. On the other hand, however, the pull-off device ought not to be switched on for too long as otherwise there is a risk of the sheet being damaged or not being properly aligned.

According to this proposal, the delay can be brought about by means of a control cam. However, this cam must be changed for another if it is intended to alter the delay. An alteration is therefore troublesome and is only possible in stages. A further disadvantage of a mechanically retarded switch-off of the pull-off device resides in the fact that the delay period runs from the moment the pull-off device is switched on. Above all, when using a suction wheel as the pull-off device, it can happen that between the moment of switching on and the commencement of transportation of the sheet, a certain time may elapse, the extent of which can vary quite considerably since it depends upon various external influences. A sheet which is late in being picked up by the pull-off device is only conveyed over a corresondingly shortened distance, which can mean that it is not taken up and transported on by the continuously operating conveyor equipment. Since the next sheet is pushed over the preceding sheet, a breakdown in operation is inevitable in such cases. The risk of such breakdowns can indeed be somewhat alleviated by providing for an increased gap between two successive sheets. This solution however only prevents breakdowns in these cases where the continuously operating conveyor apparatus is still late in taking up and transporting on the sheet which has not been conveyed sufficiently far by the pull-off device. Furthermore, increasing the distance between two sheets diminishes the performance of the sheet feeder quite considerably, particularly in the case of small-sized sheets.

The invention is based on the problem of providing a control arrangement for sheet feeders which does not have these disadvantages, which therefore requires no or at least no complicated change-over when there is a change in sheet format and/or working speed and which moreover, even with a minimal spacing between sheets guarantees a troublefree transference of the sheet conveyed by the sheet pull-off device to the continuously operating conveyor apparatus. On the basis of a control arrangement of the type mentioned at the outset, this problem is, according to the invention, resolved in that the switching arrangement has a second sensor which is to be disposed downstream of the first sensor in the path of the sheets in the direction of transport and in that a logic circuit with a storage function is provided, which so links the signals from the two sensors in the event of an adjustment, to generate control commands for the pull-off device, and stores these signals, that one binary value of the output signal of the logic circuit is associated with recognition of the rear edge of a sheet by the first sensor and the other binary value is associated with the recognition of the leading edge of a sheet by the second sensor.

In consequence, it is possible not only for the control automatically to be adapted to different sheet sizes and for the selected distance between two successive sheets to be maintained constant regardless of the working speed, but it is also ensured that independently of the moment when transportation commences, each sheet is conveyed sufficiently far by the pull-off device that it is reliably taken over by the continuously operating conveyor arrangement and is transported onwards, the next sheet only being set in motion by the pull-off device when the preceding sheet has reached the preset distance from the leading edge of the subsequent sheet. The second sensor namely maintains the pull-off device in an active condition until such time as the leading edge of the sheet which it is conveying has reached the point along the path which is determined by the position of the second sensor, at which onwards transportation by the continuously operating conveyor apparatus is guaranteed. Therefore, the fact that the pull-off device becomes effective after a time lag with respect to the switch-on command is immaterial and therefore, no breakdowns can occur for this reason. Furthermore, since the pull-off device is only switched on again when the first sensor establishes the rear edge of the sheet, the distance between the leading sheet and the following sheet depends neither on the sheet length nor on the working speed but only on the position of the first sensor. Therefore, if the two sensors are adjusted to the desired interval between two successive sheets or the distance which it is desired that the sheet pull-off device should convey the sheets, then in the case of a change of format or alteration to the working speed, the control arrangement will not need to be readjusted. At most in the case of very long sheets, it may be necessary somewhat to increase the distance between the first sensor and the second in order to obtain a considerable distance of conveyance by the pull-off device. However, since this adjustment is not critical, it can be performed quickly and without difficulty even by an operator having no special knowledge or experience, for example by using a marking. The control arrangement according to the invention therefore enhances the efficiency of the sheet feeder in that operational breakdowns are avoided, in that very small intervals can be adjusted between two successive sheets and in that adjusting times when changing to a different sheet format or a different working speed are unnecessary. Furthermore, the economy is enhanced in that by reason of the considerably simplified operation, the demands of the operator are substantially lower than in the case of known sheet feeders, so that even partially skilled persons can operate the apparatus and in that simultaneous operation of several machines is readily possible.

The logic circuit with a storage function can have at least one flip-flop to achieve the storage function. The storage function can however also be obtained by using a relay having a self-latching contact, or by using transistors. The two last-mentioned solutions make it possible in a particularly simple manner to switch the store with signals of opposite polarity over from one condition to the other and so exclude incorrect switching operations.

In the case of one advantageous from of embodiment, a dynamic input circuit is associated with each of the inputs of the flip-flop receiving signals from the sensors. This is a simple way of ensuring that sensors can be used which generate a pulse extending over the entire duration of the scanning of a sheet.

In the case of a preferred form of embodiment, the first sensor is connected to an input of the first field of the flip-flop and the second sensor is connected to the input of an intermediate element having two outputs for one and the other binary value of the output signal. In the case of an adjustment to generate control commands for the pull-off device, it is in this case the second output which delivers the inverse output signal which is connected to an input of the first field which is disjunctively linked to the other input of this field and the first output which is connected to an input of the second field of the flip-flop. Such a circuit arrangement affords an opportunity easily of switching the second sensor over to sensing the rear edge of the sheet.

In the case of an advantageous form of embodiment, the first field of the flip-flop has a further input which is disjunctively connected to the others and to which, via a pulse forming circuit the potential-carrying pole of the energy supply circuit for the logic circuit is connected. When the energy supply is switched on, the flip-flop can be actuated via this input if, as this is conveniently the case, it is so constructed that it normally moves into the released state when switched on.

As a rule, it is necessary to count the sheets which are fed. Expediently, this counting is effected by means of pulses generated by the second sensor and preferably picked up at the first output of the intermediate member disposed downstream of this sensor.

Particularly if light barriers are used as sensors, which is advantageous by reason of the contact-free method of operation, it is expedient for each of the two sensors to be followed by a pulse former circuit so that a sufficient flank steepness of the pulses applied to the dynamic input circuits is guaranteed.

In the case of a preferred form of embodiment, there is associated with the logic circuit a switch the first position of which corresponds to a setting for generation of control commands for the pull-off device and the second position of which corresponds to a setting for the generation of control commands for a glue applicating device. With such a glue applicating device, glue is applied to the sheet whereby it is frequently necessary to commence applying glue at a definite distance from the leading edge of the sheet and to complete it at a definite distance from the rear edge. Such a control of the glue applicating device can easily be achieved by positioning the first sensor at a place where the rear edge of the sheet is disposed, when the beginning of the area to which glue is to be applied is just beneath the glue applicating device. The second sensor is positioned between the glue applicator and the first sensor at a place which is reached by the rear edge of the sheet when the end of the area to be provided with glue is disposed beneath the glue applicating orifice. The signal from the first sensor which corresponds to recognition of the rear edge of the sheet then sets the gluing apparatus in operation and the signal corresponding to recognition of the rear edge of the sheet by the second sensor switches it off again when the switch which in the first position connects the first output of the intermediate element to the first input of the second field of the flip-flop and the second output of the intermediate element to an input of the first field of the flip-flop, in the second position connecting the second output of the intermediate element to the first input of the second field. The ability to switch over the control arrangement is particularly advantageous above all when the circuit is built up on one or a plurality of push-in cards, because then fewer reserve cards have to be kept in readiness for substitution in the case of a breakdown and if necessary it is possible also to use a plate of a system for controlling the pull-off device to control a glue applicator device or vice versa.

When the pull-off device is switched off, in order to prevent a sheet remaining between the pull-off device and the continuously operating conveyor, because such a sheet might cause breakdowns, particularly overlapping, when the apparatus is switched on again, an advantageous form of embodiment has downstream of the flip-flop an additional logic circuit which prevents switching off the pull-off device and/or switching it on again if a sheet has already been taken up by the push-off device but has not yet been conveyed by the continuously operating conveyor. This additional logic circuit may for example have a NAND element with three inputs, one input being provided to receive the output signals of the flip-flop, its other inputs being provided to receive the output signals of the one and the other sensor. Furthermore, the output of the NAND element is connected to an input of one field of a second flip-flop the other field of which has an input for a sheet feed signal while its output is provided for control of the pull-off device. Regardless of the switch-off or switch-on time, this additional logic circuit ensures that the pull-off device is only switched off when the second sensor has recognised the leading edge of the sheet and is only switched on again when the rear edge of the preceding sheet has been recognised by the first light barrier.

The invention will be explained in detail hereinafter with reference to various examples of embodiment which are shown in the attached drawings, in which.

Figure 6:
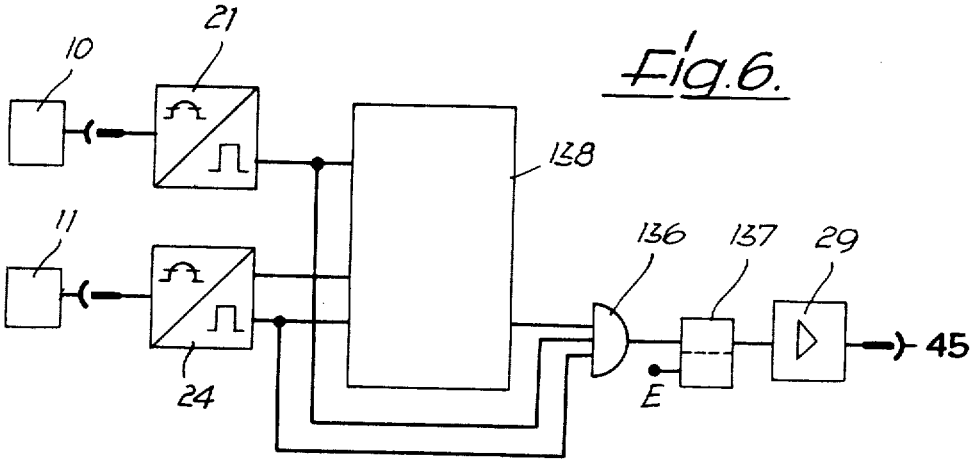
Figure 7:
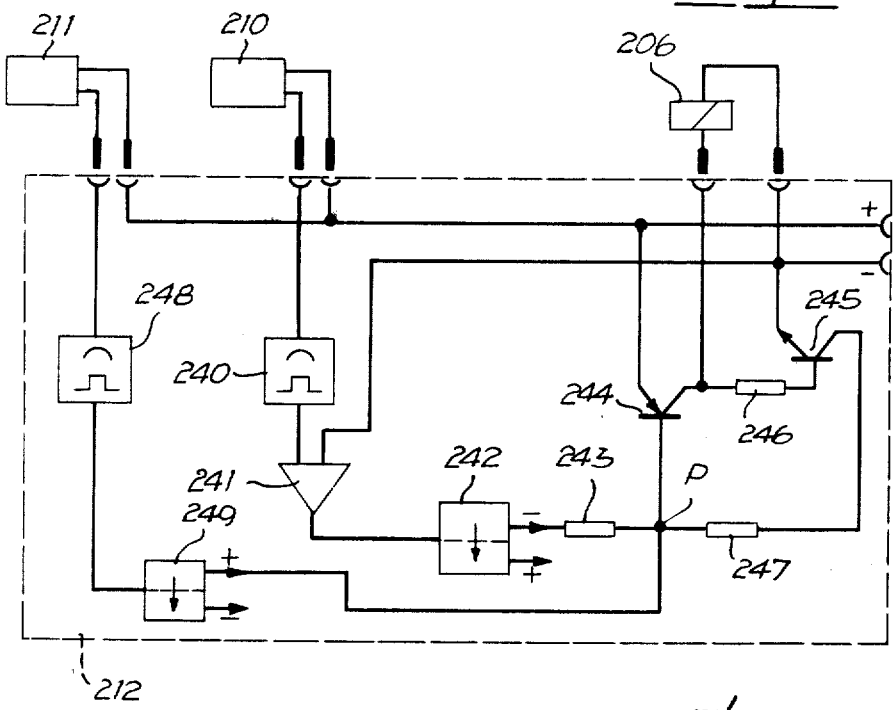
Figure 8:
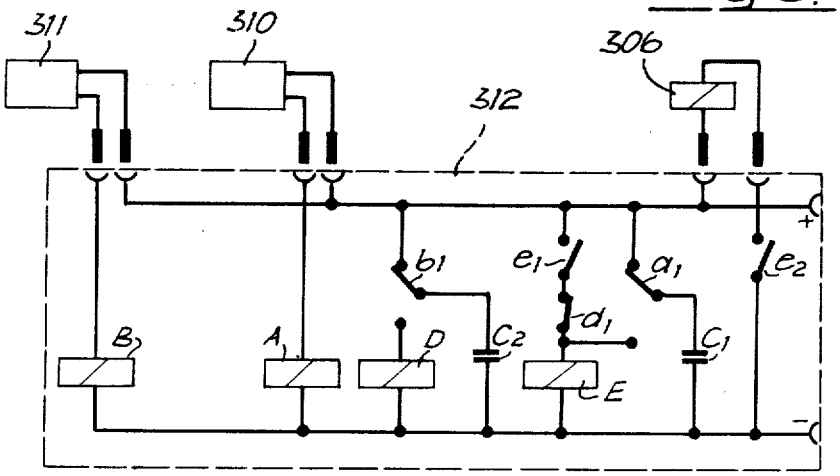

FIGS. 4*a* to 4*f* each show a diagrammatic view of the positions of the sheets to be conveyed in relation to the sensing devices for controlling the pull-off device;

FIGS. 5*a* and 5*b* each show a diagrammatic view of the positions of the sheets in relation to the sensing devices for controlling a gluing apparatus;

FIG. 6 is partial view of a circuit of a modified embodiment of the control arrangement according to the invention;

FIG. 7 shows an alternate embodiment of the part of the control circuit carried by the push-in card as well as the two light barriers and the electromagnets of the suction valve, and, FIG. 8 shows another alternate embodiment of the part of the control circuit carried by the push-in card as well as the two light barriers and the electromagnets of the suction valve.

Figure 1:
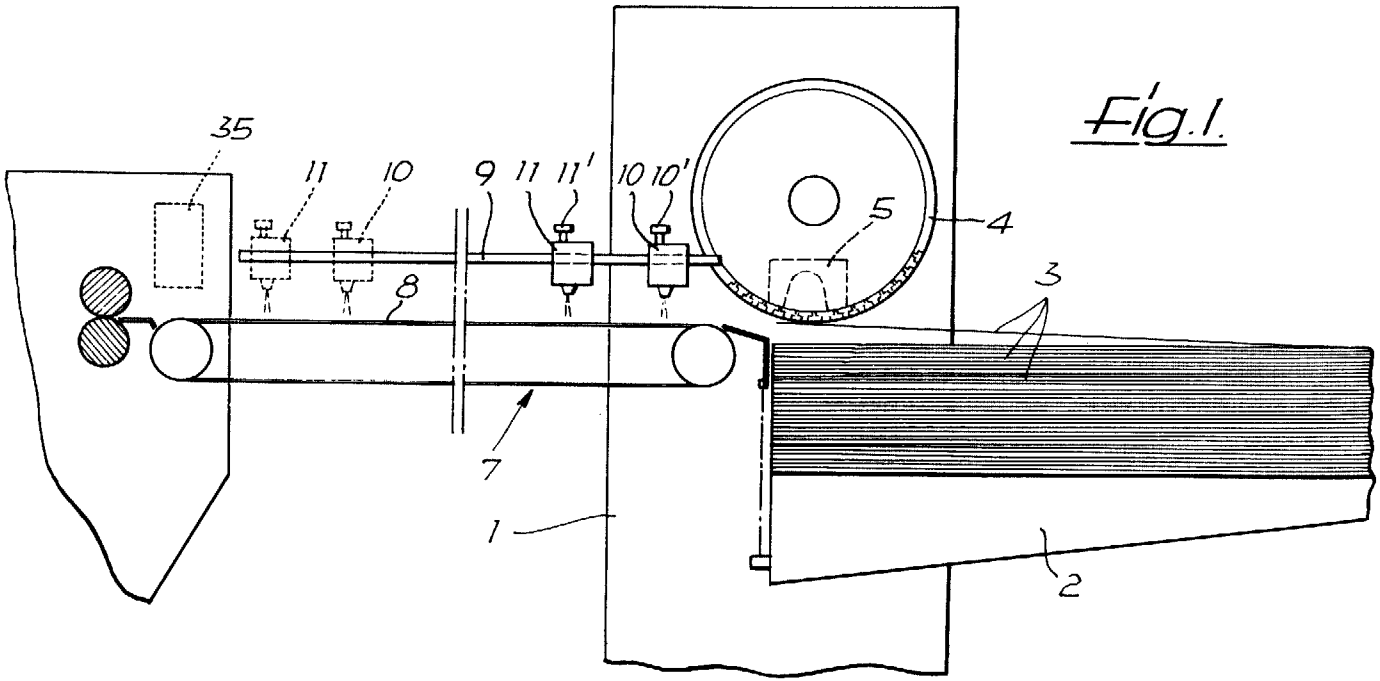
FIG. 1 shows a simplified side view of a sheet feeder with an example of embodiment of control arrangement according to the invention.

A machine frame 1 of a sheet feeder carries in vertically adjustable manner a stack table 2 which is automatically moved upwardly corresponding to the withdrawal of sheets 3 stacked on it, so that the distance between the topmost sheet and the suction wheel 4 which serves as a pull-off device is always constant. The suction wheel 4 which rotates continuously while the sheet feeder is operating is, as FIG. 1 shows, disposed above the leading marginal zone of the sheets 3 and has in its interior a fixed suction box 5 which masks only a few of the slots in the suction wheel which happen to be opposite the topmost sheet, so generating a vacuum only in the region of these slots when it is communicating with a vacuum source; not shown.

In order to control the suction box 5 and thus the conveying action of the suction wheel 4, an electromagnetically operable suction valve 6 is provided, the example of embodiment incorporating a three-way valve.

The purpose of the suction wheel 4 is to feed the sheets 3 one after another to an onward-transport table 7 which is provided with a belt conveyor 8 which operates continuously so long as the sheet feeder is operating. The onward transport table 7 has extending along the path of the sheets 3 a rail 9 on which, at any desired locations, two light barriers 10 and 11 can be disposed and secured each by a locking screw 10', 11'. The light barriers 10 and 11 operate with reflected light which is why the transmitter and the receiver are disposed in a common housing.

The light barriers 10 and 11 are parts of a control arrangement which controls the suction valve 6 and thus the conveying action of the suction wheel 4. Such a control is necessary so that regardless of the sheet format and the speed of conveyance, the sheets 3 are always transferred by the suction wheel 4 sufficiently onto the onward transport table 7 that the belt conveyor 6 can reliably take up and onwardly transport the sheets. Furthermore, it is an object of the control arrangement to maintain the distance between successive sheets at a desired value. This distance is determined by the position of the first light barrier 10, since the control arrangement is so constructed that the suction wheel 4 conveys the next sheet 3 when the rear edge of the previously conveyed sheet is passing the first light barrier 10. Movement of the first light barrier 10 to the right, as viewed in FIG. 1, therefore produces a smaller distance between successive sheets while a movement to the left increases the spacing. The distance over which the sheets 3 are conveyed by the suction wheel 4 is determined by the position of the second light barrier 11, since the control arrangement renders the suction wheel ineffective when the second light barrier 11 recognises the leading edge of the sheet. Therefore, the light barrier 11 is so positioned on the rail 9 that the sheet is reliably transported on by the belt conveyor 8 when the leading edge enters the beam of light from the light barrier 11.

All component parts and connecting lines for the control arrangement, with the exception of the two light barriers, are disposed on a card 12, also referred to as a plate, which can be inserted into a holder 13 which guides it laterally and which, in the example of embodiment, has terminals 16 capable of contacting corresponding plug contacts on the card 12.

Figure 2:
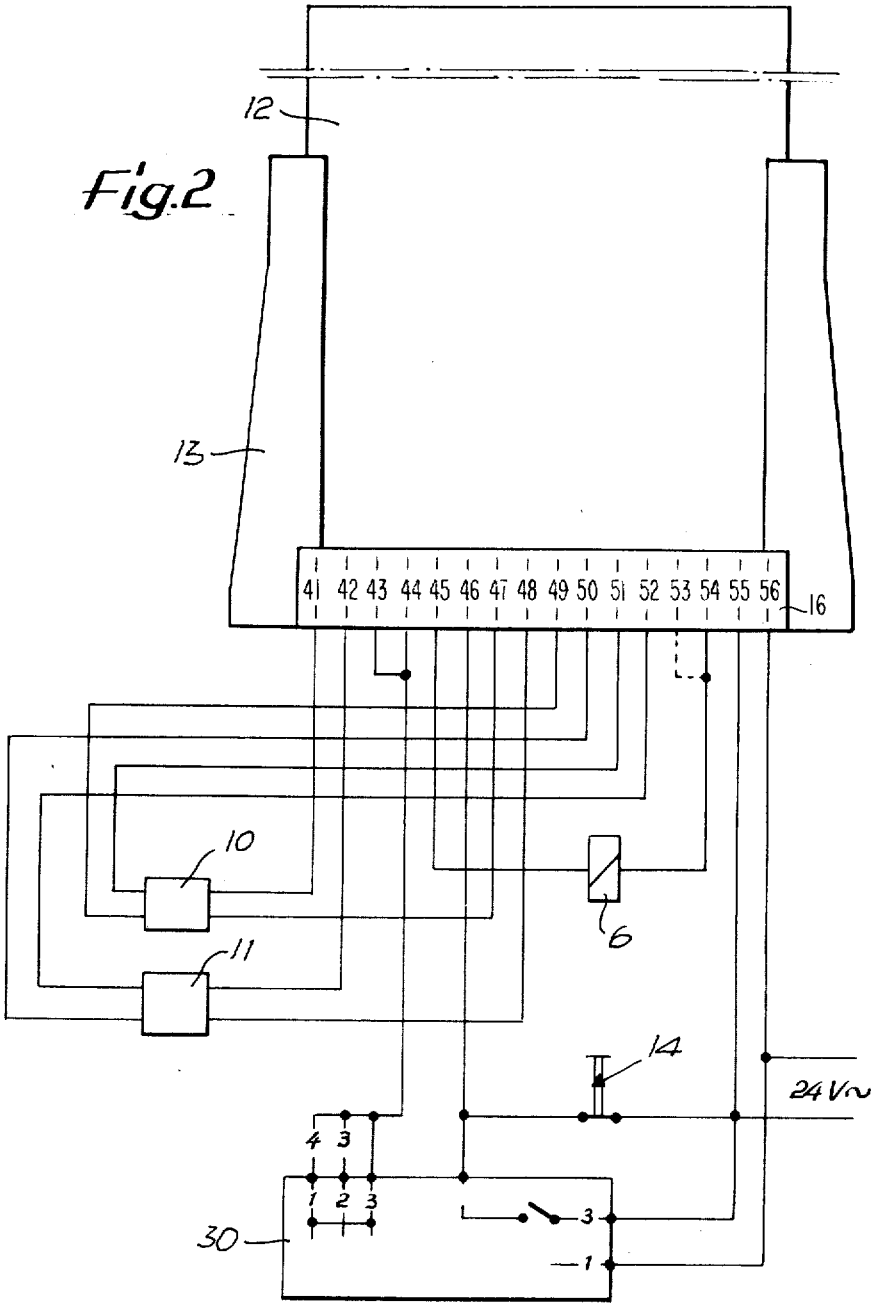
FIG. 2 shows a part of the control circuit and a view of a push-in card carrying the remaining part of the circuit, with the holder associated with it.

The control arrangement is supplied with 24 volts current from an alternating current source, now shown, usually provided in the sheet feeder. One pole of the alternating current source is connected to the terminal 56 of the holder 13, the other to terminal 55 and to the terminal 46 through a sensor switch 14 which is constructed as an opener. As FIG. 2 also shows, the electromagnetic drive of the suction valve 6 is connected to the terminals 45 and 54. The light sources for the two light barriers 10 and 11 are connected to the terminals 49 and 51 or 50 and 52, while the receivers are connected to terminals 41 and 47 or 42 and 48.

Figure 3:
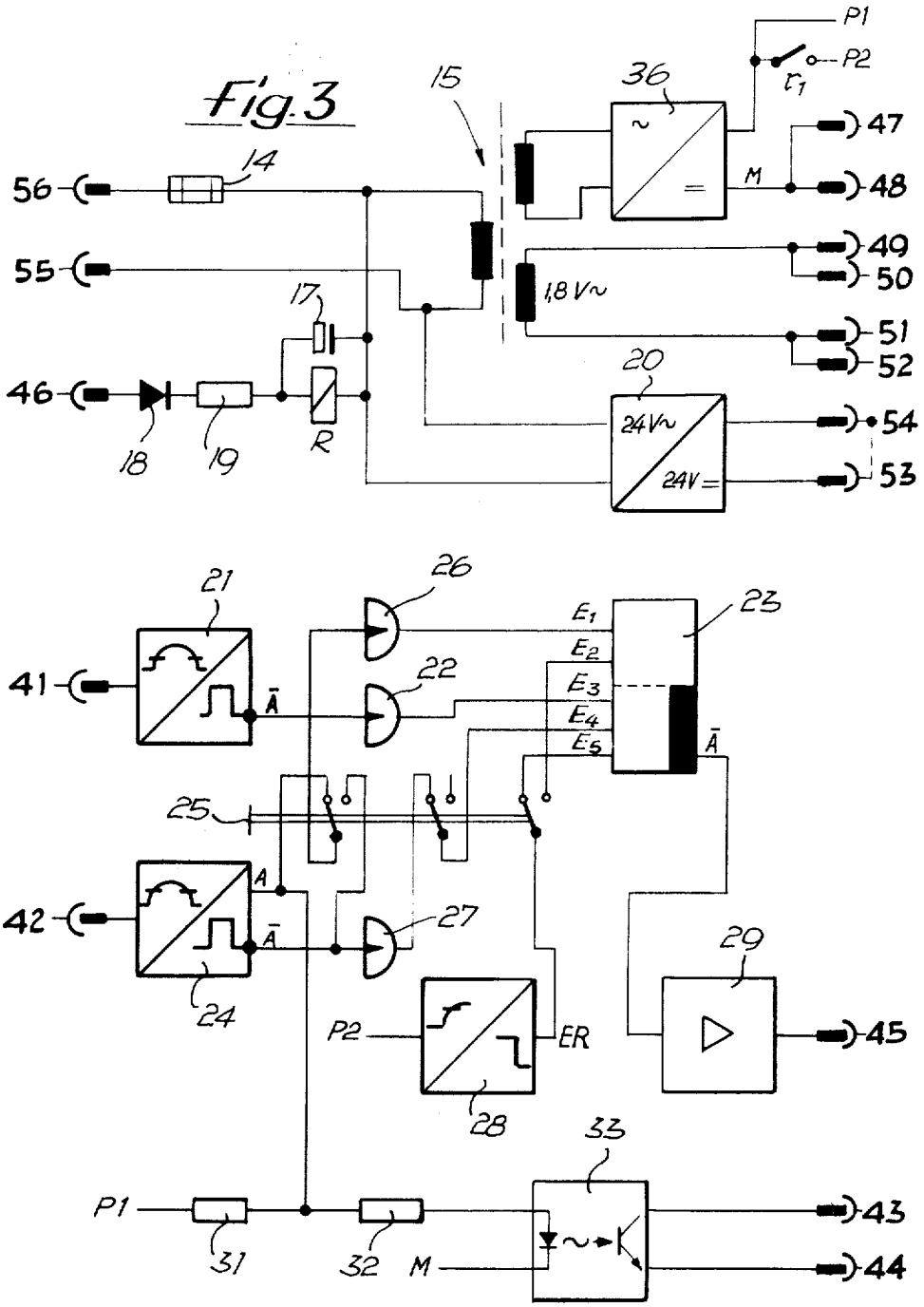
FIG. 3 shows the part of the control circuit carried by the push-in card.

FIG. 3 shows the assemblies disposed on the card 12. On the primary side, a transformer 15 is connected through a fuse to the contacts associated with the terminals 55 and 56. The secondary side of the transformer 15 feeds a rectifier 36 and also, through a separate winding, the lamps of the two light barriers 10 and 11. The generation of the direct current voltage required to operate the control arrangement via the transformer 15 has the advantage that interference voltages can substantially be kept remote from the control arrangement. The output of the rectifier 36 which is connected to earth and which is designated M is connected to the terminals 47 and 48. The other output divides into a branch $P_1$ and a branch $P_2$.

Disposed in the branch $P_2$ is a closed circuit $P_1$ of a relay R connected in parallel with which there is a capacitor 17, and which is connected on the one hand to the contact associated with the terminal 56 and on the other to a series connection comprising a diode 18 and a resistor 19 and which is in turn connected to the contact associated with the terminal 46. Via the terminals 55 and 56, a second rectifier 20 which supplies the voltage to energise the suction valve 6, is also fed.

The signals generated by the light barrier 10 are fed to a pulse former 21 which generates rectangular pulses. The output of this pulse former 21 which yields an inverse signal is connected via a dynamic input circuit 22 which in the example of embodiment illustrated corresponds to a change-over of the input signal from 1 to 0, is connected to an input $E_3$ of the second field of a flip-flop 23. The output A of the second field has in its basic position the condition 1.

The second light barrier 11 is connected to a pulse former 24 which in addition to an output $\overline{A}$ has an inverse output $\overline{A}$. The output A is, in one switch position of a reversing switch 25 shown in FIG. 3 and having two switch positions, connected to a dynamic input circuit 26 which is constructed in the same way as the dynamic input circuit 22. The dynamic input circuit 26 precedes an input $E_1$ of the first field of the flip-flop 23.

In the other switch position of the change-over switch 25, this latter connects the output $\overline{A}$ of the pulse former 24 to the dynamic input circuit 26. In the case of the first switch position of the change-over switch 25, shown in FIG. 3, in which control commands for the suction valve 6 are produced, on the other hand, the output A of the pulse former 24 is connected through a dynamic input circuit 27 which is constructed in the same way as the dynamic input circuit 26, and via a second set of contacts of the change-over switch 25, to an input $E_4$ of the second field of the flip-flop 23.

A third set of contacts on the change-over switch 25 connects the output of a pulse former 28 which converts a rising flank of an input signal into the trailing flank of a rectangular pulse, is in the first switch position connected to the input $E_5$ of the second field and in the second switch position is connected to an input $E_2$ of the first field of the flip-flop 23. The input of this pulse former 28 is connected to the branch $P_2$ of the output of the rectifier 36.

Disposed downstream of the output $\overline{A}$ of the flip-flop 23 is an amplifier 29, the output of which is connected to the contact associated with the terminal 45.

Since it is generally desired to count the number of sheets 3 which are conveyed and to produce a small gap after a selectable number of sheets, in order to facilitate grouping of the sheets together into quantities of a definite number, a counter 30 (FIG. 2) is provided which obtains its counting pulses from the pulse former 24 disposed downstream of the second light barrier 11. As FIG. 3 shows, the output A of the pulse former 24 is connected to the point of connection of two resistors 31 and 32 which are connected in series and which connect one input of an initial stage 33 to the branch $P_1$ of one output of the rectifier 36. The other input is connected to the earthed output of the rectifier 36. Connected to the output of the initial stage 33 via the terminals 43 and 44 is the input to the counter 30.

The two pulse formers 21 and 24 receive their operating voltage through the branches $P_1$ and M, the pulse former 28, the dynamic input circuits 22, 26 and 27, the flip-flop 23 and the amplifier 29 receiving their operating voltage through the branches $P_2$ and M.

Before the control arrangement is switched on, the drive of the suction wheel 4 and the belt conveyor 8 are switched on. The sheets 3 at this moment are still all on the stack table 2, as shown in FIG. 4a. When, then, the control arrangement is switched on, the flip-flop 23 is in the erased state, in which it generates an output signal which produces an opening of the suction valve 6 and thus a withdrawal of the topmost sheet 3 from the stack by the suction wheel, this sheet being conveyed onto the onward transport table 7.

As FIG. 4a shows, the two light barriers 10 and 11 initially produce no signals since there is no sheet beneath them.

When the first sheet arrives beneath the first light barrier 10 (FIG. 4b), then this light barrier generates a signal to which the dynamic input circuit 22 does not respond and which therefore does not arrive at the input $E_3$ of the flip-flop 23. Since the flip-flop is already in the erased state, this input signal produces no change in the condition of the flip-flop. Only when the leading edge of the sheet enters the beam of light from the second light barrier 11 (see FIG. 4c) does the resultant signal which passes through the pulse former 24, the output A thereof and, at the first switch position of the change-over switch 25, via the dynamic input circuit 26, to the input $E_1$ of the flip-flop 23, result in an operation of the flip-flop. In consequence, the output signal of the flip-flop disappears and the suction valve 6 is closed. The conveying action exercised by the suction wheel 4 is thus completed.

When the leading edge of the sheet 3 comes into the beam of light from the light barrier 11, a signal arises at the output $\overline{A}$ of the pulse former 24, the signal changing from 0 to 1. Since the dynamic input circuit 27 does not respond to such a signal, no signal occurs at the input $E_4$ when the leading edge of the sheet reaches the light barrier 11.

When the first light barrier 10 recognises the rear edge of the sheet moving beneath the light barrier 11, a signal passes through the pulse former 21 and the dynamic input circuit 22 to the output $E_3$ which changes the flip-flop 23 to the erased condition. The result is an output signal which switches over the suction valve through the amplifier 29 and renders the suction wheel 4 operative again. The next sheet is therefore conveyed when there is between the leading edge of this sheet and the trailing edge of the previously conveyed sheet the distance determined by the position of the first light barrier 10.

Independently of whether the suction wheel 4 immediately commences to convey the second sheet or whether the conveying action of the suction wheel starts after a time lag, the second sheet is conveyed sufficiently far by the suction wheel for its leading edge to be detected by the second light barrier 11 (FIG. **4*f*). Since onward feeding by the belt conveyor 8 is assured, the signal generated by the second light barrier again operates the flip-flop 23 and the suction valve 6** is switched over to the condition whereby the suction wheel is rendered inoperative.

If, by reason of a breakdown, detection of the trailing edge of a sheet by the first light barrier 10 does not result in erasure of the flip-flop 23, then a signal generated by the second light barrier 11 upon detecting the trailing edge of a sheet and which passes through the output A of the pulse former 24 and the dynamic input circuit 27 to the input $E_4$ of the second field of the flip-flop 23, erases the flip-flop so establishing the condition in which the suction wheel is effective.

The pulse occurring at the input of the pulse former 28 when the supply of power for the control arrangement is switched on produced in the first switch position of the change-over switch 25, at the input $E_5$ a signal which converts the flip-flop 23 to the erased condition and, at the second switch position of the change-over switch 25, it generates at the input $E_2$ a signal which operates the flip-flop 23.

Instead of being used to control the suction valve 6, the previously described control arrangement can also be used for controlling a glue applicator 35, by means of which glue can be applied onto the sheets 3 conveyed, in the example of embodiment illustrated, by the belt conveyor 8, in a zone which commences at a distance from the leading edge of the sheet and which ends at a distance from the trailing edge of the sheet. The glue applicator which has an electromagnetically operable valve is shown diagrammatically by broken lines in FIG. 1 and is disposed close to the end of the belt conveyor 8. Where the controlling of this glue applicator 35 is concerned, the first light barrier 10 is positioned at such a distance from the glue applicator 35, on the rail 9, that the glue applicator 35 is at a distance from the leading edge of the sheet at which application of glue is intended to commence. The second light barrier 11 on the other hand is so positioned on the rail 9 that when it detects the rear edge of the sheet, the glue applicator is positioned over that part of the sheet where the application of glue is to end.

For controlling the glue applicator, the change-over switch 25 is brought into the second switch position in which the output $\overline{A}$ of the pulse former 24 is connected to the dynamic input circuit 26. Upon switching on the supply of power to the control apparatus, the pulse arriving at the input $E_4$ via the pulse former 28 ensures that the flip-flop 23 is operated so that the emergence of glue from the glue applicator connected to the amplifier 29 is prevented. When the first light barrier 10 detects the rear edge of a sheet 3 (FIG. 5a), then a pulse passing via the pulse former 21 and the dynamic input circuit 22 to the input $E_3$ of the flip-flop 23 erases the flip-flop 23 so allowing glue to emerge. As soon as the second light barrier 11 recognises the trailing edge of this sheet, a pulse passes via the pulse former 24, its output $\overline{A}$ and the dynamic input circuit 26 to the input $E_1$ of the flip-flop 23 which operates the flip-flop and so blocks the emergence of glue. It is only released again when the first light barrier 10 detects the trailing edge of the next sheet. The leading edge of this sheet produces no change in the condition of the flip-flop 23, since the dynamic input circuits 22 and 26 do not respond to pulses from the leading edge of the sheet.

Where the suction valve 6 is controlled by means of the aforedescribed control arrangement, the conveying action of the suction wheel 4 could be switched off or on manually but; if the switching time is unfavourably chosen, this could result in a sheet already conveyed a distance by the suction wheel need not be transported sufficiently far to be taken up by the belt conveyor 8, or a new sheet might be conveyed by the suction wheel before the rear edge of the previously fed sheet has passed the first light barrier 10. Even if a manually operable switch is provided, such an inappropriately timed action could be prevented by an additional logic circuit. An example of embodiment which is modified by such an additional logic circuit is shown in FIG. 6.

In the case of this example of embodiment, the additional logic circuit consists of a NAND element 136 with three inputs, to the output of which is connected one input of a cross-coupled NAND grid shown as a second flip-flop 137. One input of the NAND element 136 is connected to the output A of the first flip-flop 23 which is not shown in detail in FIG. 6. Instead, since there are no differences over the example of embodiment shown in FIGS. 1 to 5, the logic circuit containing the first flip-flop 23 is represented by the block 138.

The other two inputs of the NAND element 136 are connected to one and respectively the other inverse outputs of the two pulse formers 21, 24 which are disposed after the two light barriers 10, 11.

The second input E of the second flip-flop 137 is connected to a control signal transmitter, not shown, which generates a 1-signal when sheet feeding is switched off manually. When sheet feeding is switched on, an 0-signal is applied to the input E.

The output of the second flip-flop 137 is connected to the input of the amplifier 29.

FIG. 7 shows an alternate embodiment of the control circuitry which operates as described below.

The first light barrier 210 is connected through plugs on the one hand to a conductor on the card 212 which carries positive potential, and on the other to a Schmitt trigger 240 which at the same time constitutes a preamplifier. The output of the Schmitt trigger 240 is connected to one input of an inverter 241, the other input of which constantly has a negative potential applied to it. At its output, the inverter 241 delivers a negative signal when the input connected to the Schmitt trigger is zero. If this input is positive, then the output of the inverter is zero.

The output of the inverter is connected to a monostable flip-flop 242 which, regardless of the duration of the input signals, delivers output signals of a definite duration. In the example of embodiment, the pulse duration tm is approximately 10 msec. Of the two outputs of the monostable flip-flop 242, only that one is used at which a negative output signal occurs during the time when the flip-flop is in its unstable condition due to an input signal. This output is connected through a resistor 243 to a point P to which the base of a pnp transistor is connected. The emitter of this transistor is connected to a conductor carrying positive potential. From the collector, a first connecting lead passes through a plug to the electromagnet 206 of the suction valve which is on the other hand connected through a plug to the emitter of an npn transistor 245. A second connecting lead runs from the collector of the transistor 244 via a resistor 246 to the base of a transistor 245, the emitter of which is connected to the point P through a resistor 247.

The second light barrier 211 is connected through plugs on the one hand to the positive potential and on the other to a Schmitt trigger 248 which is constructed like the Schmitt trigger 240 and which at the same time constitutes a preamplifier. The output of the Schmitt trigger 248 is connected to a second monostable flip-flop 249 which, like the flip-flop 242, delivers pulses of a definite duration regardless of the pulse duration of the input pulses. This pulse duration is approximately 10 msec. in the example of embodiment. This short duration of the putput pulses from both monostable flip-flop excludes the possibility of both the flip-flop 242 as well as the flip-flop 249 simultaneously delivering an output signal. By reason of a positive input signal, the flip-flop 249 changes to its unstable state. That of the two outputs at which a positive signal arises in the unstable state, is connected to the point P. The pulses triggered by the two light barriers and arriving at the point P therefore have opposite potential.

When the light barrier 210 recognises the trailing edge of a sheet which is being fed, the output signal of the Schmitt trigger 240 becomes zero so that a negative signal reaches the input of the flip-flop 242 and triggers a negative pulse which passes via the resistor 243 to the base of the transistor 244 and so renders this conductive. In consequence, the transistor 244 passes via the resistor 246 a positive potential to the base of the transistor 245 which likewise becomes conductive thereby and thus maintains a negative potential at the base of the transistor 244 via the resistor 247. As soon as the transistor 244 becomes conductive, the electromagnet 206 of the suction valve which is disposed in its collector-emitter circuit becomes energised so that the suction valve is opened. By virtue of the storage function of the transistors 244 and 245, the electromagnet 206 initially remains energised. When the light barrier 211 recognises the leading edge of the next sheet, then a positive pulse passes to the input of the flip-flop 242 so that this latter delivers a positive pulse to the point P. The effect of this positive pulse is to block both transistors 244 and 245.

The use of the inverter 241 could be avoided if two light barriers were used, delivering signals of opposite potential. Such light barriers are known. The use of different light barriers is however disadvantageous in that they cannot then any longer be interchanged with each other.

The differing polarity of the signals produced by the two light barriers prevents breakdowns such as can occur for example when a sheet sticks in the region of the light barriers and has to be removed by hand, resulting in an incorrect relationship between the storage function of the logic circuit and the signals of the light barriers. A plurality of successive signals from one or other light barrier can therefore not result in breakdowns. A further advantage resides in the fact that, without additional expenditure, the apparatus can be set in motion and switched off, since it is necessary only to make or break the connection to the light barrier 210 in order to achieve this. Similarly avoided without additional expenditure is a condition whereby, upon the apparatus being switched off at any desired point in time, a sheet which may just have been taken up is no longer completely conveyed, since a break in the connection to the light barrier 210 only prevents the suction wheel being switched on again. However, even after the connection with the light barrier 210 has been broken, the suction wheel remains switched on until such time as it is switched off by a signal from the light barrier 211.

FIG. 8 shows an example of embodiment which operates in principle like the embodiment shown in FIG. 4. Here, the logic circuit is provided by means of various relays which are all disposed on a pushin card 312. The two light barriers 310 and 311 and also the electromagnet 306 of the suction valve are connected to this pushin card.

A relay A lies in the circuit of the first light barrier 310 and a relay B in the circuit of the second light barrier 311. The relay A has a switch-over contact $a_1$ which, when the relay is not energised, connects a capacitor $c_1$ to a direct voltage source. So long as the relay A is energised, the switch-over contact $a_1$ connects the capacitor $c_1$ to relay E which is energised by reason of the capacitor discharging. Since the relay E has a self-latching contact $e_1$, it remains subsequently energised. Apart from the self-latching contact $e_1$, the connecting lead of the relay A which extends to the positive pole of the voltage source and which is on the other hand like all other relays and the capacitors connected to the negative potential, there is an open circuit contact $d_1$ of a relay D. So long as this relay D is not energised, its open circuit contact $d_1$ is closed. A switch-over contact $b_1$ of the relay B, when the relay B is not energised, connects a capacitor $C_2$ to the positive pole of the voltage source. When the relay B is energised, as is the case when the light barrier 311 recognises the leading edge of a sheet, the capacitor $C_2$ is connected by the switch-over contact $d_1$ to the relay D which is briefly energised thereby. This brief excitation causes the relay E to drop so opening its closed circuit contact $e_2$ which lies in the circuit of the electromagnet 306 of the section valve. The closed circuit contact $e_2$ is then only closed again when the first light barrier 310 produces an excitation of the relay A, since then the capacitor $C_1$ which has charged in the meantime discharges through the relay E and so energises this latter.

The advantages of this circuit are the same as those according to FIG. 7.

We claim:

1. A control device for a sheet feeder, said sheet feeder including pickup means to remove individual sheets from a stack of such sheets and conveying means arranged to accept said individual sheets from said pickup means and transport said individual sheets along a transport path away from said pickup means; said control device including first sensing means mounted along said transport path at a first predetermined distance from said pickup means, said first sensing means being responsive to the passage of the trailing edge of each of said sheets along said transport path to generate first control signals;

second sensing means mounted along said transport path at a second predetermined distance from said pickup means, said second predetermined distance being greater than said first predetermined distance, said second sensing means being responsive to the passage of the leading edge of each of said sheets to generate a second control signal; and a first logic circuit which is connected to said first and said second sensing means and is responsive to said first control signal to activate said pickup means and to said second control signal to deactivate said pickup means.

2. A control device as claimed in claim 1 in which said logic circuit includes signal storage means responsive to said first and second control signals to activate said pickup means in the period between the generation of said first and second control signals.

3. A control device as claimed in claim 2 in which said signal storage means includes at least one flip-flop circuit.

4. A control device as claimed in claim 2 in which said signal storage means includes at least one relay.

5. A control device as claimed in claim 1 in which said logic circuit includes a flip-flop having at least a first, a second and a third input terminals and an output terminal, which output terminal is connected to activating means for said pickup means, said flip-flop being arranged to generate an activating signal for said pickup means upon receipt of a signal on said second or third inputs and to cease generating said activating signal upon receipt of an input signal on said first input; a first, a second and a third dynamic circuits each of which has an input and an output terminal, the output terminals of said dynamic circuits being connected respectively to the input terminals of said flip-flop; a first pulse forming circuit having an input terminal connected to said first sensor and responsive to said first control signals and an output terminal connected to the input of said second dynamic circuit, said first pulse forming circuit generating a negative output signal on said output terminal, and a second pulse forming circuit having an input connected to said second sensor and responsive to said second control signals and first and second output terminals connected respectively to said input terminals of said first and third dynamic circuits, said second pulse forming circuit generating a positive output signal at said first output and a negative output signal at said second output.

6. A control device as claimed in claim 5 in which said flip-flop includes a fourth and a fifth input terminals said flip-flop being arranged to generate an activating signal for said pickup means upon receipt of an input signal on said fifth input terminal and to cease generating said activating signal upon receipt of an input signal on said fourth input terminal; and further including reset means, said reset means including a third pulse forming circuit the output of which is switchable between said fourth and fifth input terminals of said flip-flop and the input of which is connected to a voltage source.

7. A control device as claimed in claim 6 in which said reset means further includes a relay having a closed circuit contact set which is connected between said voltage source and said third pulse former.

8. A control device as claimed in claim 5 including switch means having one input connected to the first output of said second pulse former and a second input connected to the second output of said second pulse former, the output of said switch means being connected to the first input of said flip-flop, said switch means being operable to apply either of the outputs of said second pulse former to said first input of said flip-flop.

9. A control device as claimed in claim 5 including a second logic circuit having input terminals connected respectively to the output of said flip-flop, the output terminal of said first pulse forming circuit and the second output terminal of said second pulse forming circuit, said second logic circuit being adapted to activate said pickup means as long as signals are present on all of said input terminals.

10. A control device as claimed in claim 9 in which said second logic circuit includes a NAND gate and a second flip-flop, said NAND gate having three inputs connected respectively to the output of said flip-flop, the output terminal of said first pulse forming circuit and the second output terminal of said second pulse forming circuit, said NAND gate having an output terminal connected to an input terminal of said second flip-flop and means connected to a second terminal of said second flip flop to provide a signal at said second terminal of said flip-flop when said sheet feeder has been manually deactivated.

11. A control device as claimed in claim 1 including counting means responsive to said second control signals.

12. A control device as claimed in claim 1 in which said first and second sensors are light barriers.

13. A control circuit as claimed in claim 1 in which said logic circuit includes first circuit means responsive to said first control signal to generate a predetermined negative signal at a circuit terminal, second circuit means responsive to said second control signal to generate a predetermined positive signal at said circuit terminal, and signal storage means for generating said activating signal for said pickup means said signal storage means including an npn transistor, and a pnp transistor, said pnp transistor having its base electrode connected to said terminal, its emitter electrode connected to a source of reference potential and its collector electrode connect to the base electrode of said npn transistor through a resistor the collector of said npn transistor being connected to said terminal through a resistance and the emitter of said npn transistor being connected to a source of reference potential, said activating signal being generated at said terminal to bias said transistors into a conducting state until said positive signal is generated at said terminal to cut said transistors off.

14. A control circuit as claimed in claim 13 in which said first circuit means includes a first schmitt trigger preamplifer, an inverter having two inputs, and a first flip-flop and in which the input terminal of said schmitt trigger is connected to said first sensor and the output terminal of said schmitt trigger is connected to a first input of said inverter, the second input of said inverter being connected to a source of negative potential, the output of said inverter being connected to the input of said flip-flop and the negative output of said flip-flop being connected to said circuit terminal.

15. A control circuit as claimed in claim 14 in which said second circuit means includes a second schmitt trigger and a second flip-flop and in which the input terminal of said second schmitt trigger is connected to said second sensing means, the output of said second schmitt trigger is connected to the input of said second flip-flop and the positive output of said second flip-flop is connected to said circuit terminal.

16. A control device as claimed in claim 1 in which said logic circuit includes a first relay which is connected to said first sensor and energized by said first control signal, a second relay which is connected to said second sensor and energized by said second control signal, a third relay, first means to energize said third relay, when said first relay is energized and second means to deenergize said third relay when said second relay is energized and in which said pickup means is activated only while said third relay is energized.

17. A control device as claimed in claim 1 in which said logic circuit includes a first relay which is connected to said first sensor and is energized by said first control signal, said first relay having a first switch over contact, first capacitance means connected to said first switch over contact, a second relay which is connected to said second sensor and is energized by said second control signal, said second relay having a second switch over contact, second capacitance means connected to said second switch over contact, a third relay having a normally closed open circuit contact, and a fourth relay having a self latching contact connected in series with said normally closed open circuit contact of said third relay, said switch over contact of said first relay connecting said first capacitance means to said fourth relay when said first relay is energized causing said self latching contact of said fourth relay to close energizing said fourth relay through said normally closed open circuit contact of said third relay and said switch over contact of said second relay connecting said second capacitance to said third relay when said second relay is energized causing said second relay to be energized and causing said normally closed open circuit contact to open deenergizing said fourth relay.

* * * * *